US009410682B1

(12) United States Patent
Wang

(10) Patent No.: US 9,410,682 B1
(45) Date of Patent: Aug. 9, 2016

(54) ASSEMBLED LIGHTING STRUCTURE FOR A PANEL OF A SHELF

(71) Applicant: ED520 ENTERPRISE CO., LTD., Changhua (TW)

(72) Inventor: Yu-Lin Wang, Changhua (TW)

(73) Assignee: ED520 ENTERPRISE Co., Ltd., Puyan Township, Changhua County (TW)

( * ) Notice: Subject to any disclaimer, the term of this patent is extended or adjusted under 35 U.S.C. 154(b) by 46 days.

(21) Appl. No.: 14/659,439

(22) Filed: Mar. 16, 2015

(51) Int. Cl.

| | |
|---|---|
| ***F21V 21/34*** | (2006.01) |
| ***F21V 19/00*** | (2006.01) |
| *F21Y 103/00* | (2016.01) |
| *F21W 131/405* | (2006.01) |

(52) U.S. Cl.
CPC ..... *F21V 21/34* (2013.01); *F21V 19/003* (2013.01); *F21W 2131/405* (2013.01); *F21Y 2103/003* (2013.01)

(58) Field of Classification Search
CPC ..... F21V 21/34; F21V 19/003
See application file for complete search history.

(56) References Cited

U.S. PATENT DOCUMENTS

2016/0061429 A1* 3/2016 Waalkes et al. ..... F21V 23/00 362/217.15

* cited by examiner

*Primary Examiner* — David V Bruce
(74) *Attorney, Agent, or Firm* — Yuwen Guo

(57) ABSTRACT

An assembled lighting structure for a panel of a shelf is provided. The structure comprises a connection unit, a receiving unit, a LED assembly, a first clip unit, and a second clip unit. The connection unit is connected with an outside of a front-edge groove. The receiving unit is connected with one side of the panel distant from the connection unit and inclined upwardly and outwardly. The LED assembly is arranged at an upper surface of the receiving unit. Lights of the LED assembly are emitted toward inside the panel. The first clip unit is connected with one end of the receiving unit distant from the connection unit for providing a first display strip to be removably clipped and fastened. The second clip unit is extended from a bottom end of the receiving unit downwardly for providing a second display strip to be removably clipped and fastened.

8 Claims, 14 Drawing Sheets

ASSEMBLED LIGHTING STRUCTURE FOR A PANEL OF A SHELF

FIELD OF THE INVENTION

The present invention relates to a shelf, and more particularly to an assembled lighting structure for a panel of a shelf.

BACKGROUND OF THE INVENTION

The recent lighting structure for a panel of a shelf may reference to TW Patent No. M479077. It discloses a modularized lighting panel structure of a shelf which comprises a supporting frame and plurality of modularized lighting panels. The supporting frame has lots of setting portions spaced apart from each other and lots of power supply portions arranged corresponding to the setting portions respectively. Each modularized panel includes a plate, a lighting unit disposed at the plate, a control circuit built in the plate and electrically connected to the lighting unit, and an electric connection unit extended from inside of the plate toward the periphery of the plate and electrically connected to the control circuit. When each modularized lighting panel is arranged one of the setting portions and disposed on the supporting frame, the electric connection is electrically connected to each corresponding power supply portion.

However, the above mentioned lighting unit is disposed at the lower surface of the plate and the lighting unit may include a plurality of searchlights or LED strips. That is, lights of the lighting unit arranged at the lower surface of the upper-layer plate is emitting to the upper surface of the lower-layer plate. But if the display strip at front edge need to be shown, one more backlight module need to be arranged behind the display strip to have better lighting. Therefore, power consumption is very large and cost is raised. The use of power is easy overloading to result in danger of fire.

SUMMARY OF THE INVENTION

An objective of this invention is providing an assembled lighting structure for a panel of a shelf. The structure is simplified and lights of the LED assembly may be directly emitted to products arranged on the panel so that the first display strip may be served as a backlight module. Therefore, there is not necessary to use two light sources. And the structure may be also used for clipping and fastening the first display strip shown the trademark and name of the productions and the second display strip shown the price of the productions for saving power and cost down.

To achieve above objectives, an assembled lighting structure for a panel of a shelf is provided. The structure may comprise: a connection unit, connected with an outside of a front-edge groove of a panel of a shelf; a receiving unit, connected with one side of the panel of the shelf distant from the connection unit and inclined upwardly and outwardly; a LED assembly, arranged at an upper surface of the receiving unit, lights thereof are emitted toward inside the panel of the shelf; a first clip unit, connected with one end of the receiving unit distant from the connection unit for providing a first display strip to be removably clipped and fastened; and a second clip unit, extended from a bottom end of the receiving unit downwardly for providing a second display strip to be removably clipped and fastened.

In some embodiment, the connection unit includes a hook portion, a vertical plate portion, an L-shaped plate portion, and a bolt, the vertical plate portion is flush with the outside of the front-edge groove, the hook portion is connected to a top end of the vertical plate portion and against inside the front-edge groove, the L-shaped plate portion has a horizontal section and a vertical section, the horizontal section is connected to a bottom end of the vertical section and extended toward the panel of the shelf so that the horizontal section is disposed under the panel of the shelf, the vertical section is connected to one end of the horizontal section distant from the vertical plate portion and extended upwardly, and the bolt is passing through the vertical section of the L-shaped plate portion and against an inside of the front-edge groove.

The receiving unit may be connected to the bottom end of the vertical plate portion of the connection unit and extended outwardly and upwardly.

In some embodiment, the connection unit is a plate directly welded at the outside of the front-edge groove.

The receiving unit is connected to the bottom end of the connection unit and extended outwardly and upwardly.

In some embodiment, the connection unit includes a vertical plate portion and a plurality of bolts, the vertical plate portion is flush with the outside of the front-edge groove, each bolt is passing through the vertical plate portion and the outside of the front-edge groove to be fastened at the vertical plate portion, and the bolts are spaced apart from each other.

The receiving unit is connected to the bottom end of the vertical plate portion of the connection unit and extended upwardly and outwardly.

In some embodiment, the first display strip is made by transparent or semi-transparent materials, and the second display strip is made by opaque materials.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
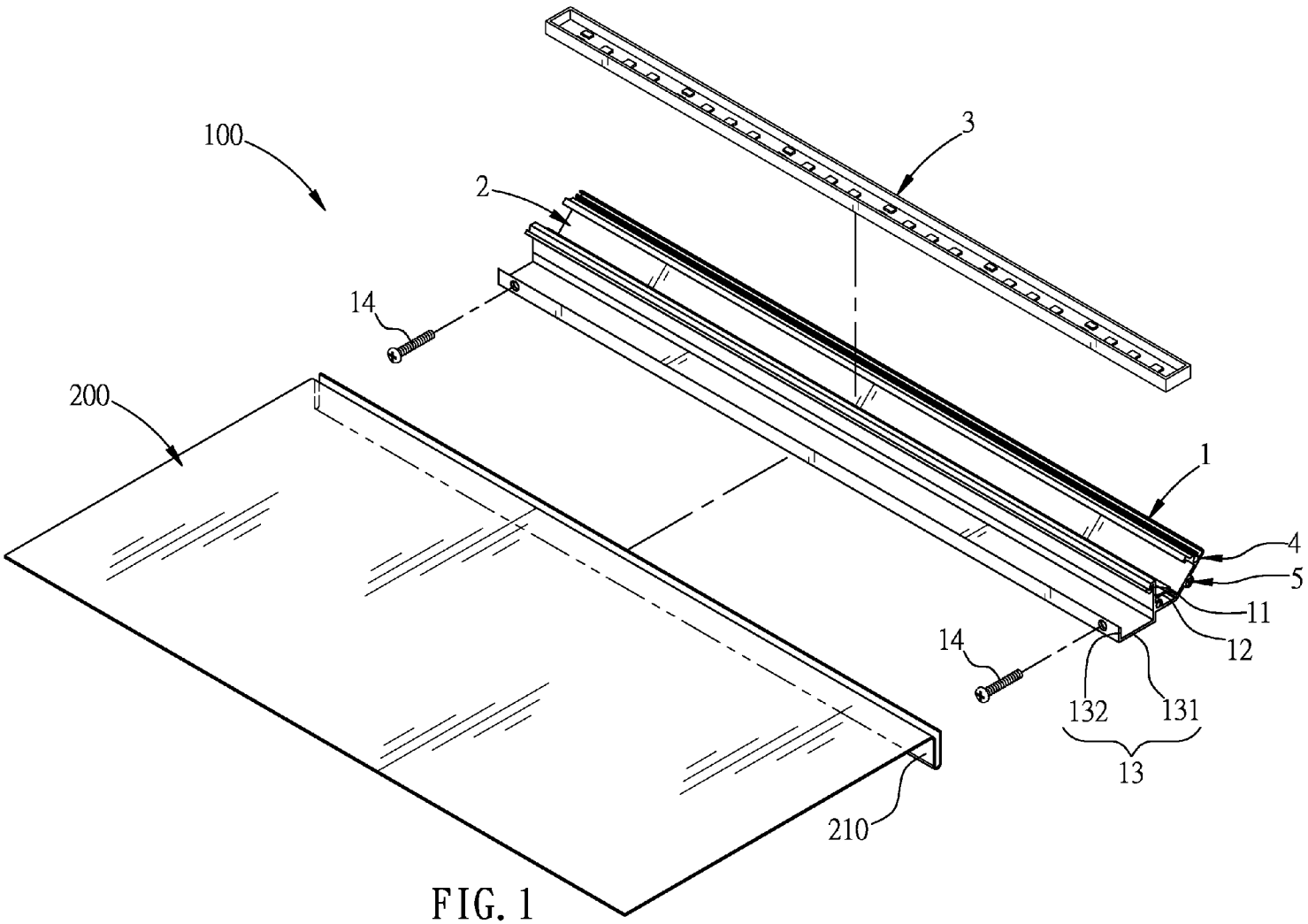
FIG. 1 is an exploded view of a first embodiment of an assembled lighting structure for a panel of a shelf according to this present invention.
Figure 2:
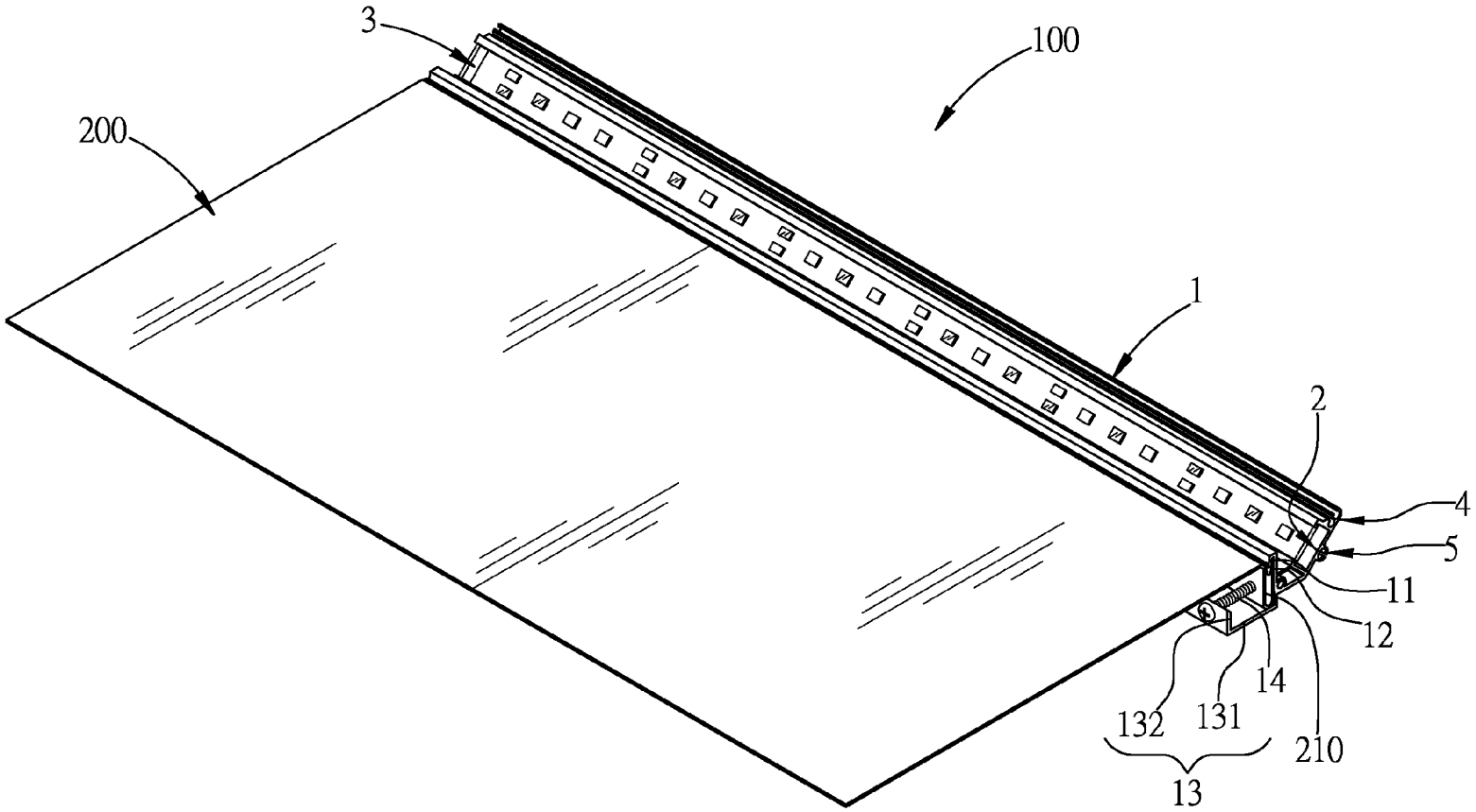
FIG. 2 is a perspective view of the first embodiment according to this present invention.

Referring now to the drawings where like characteristics and features among the various figures are denoted by like reference characters.

Please refer to FIGS. 1 to 8, the assembled lighting structure 100 of a panel 200 of a shelf according to this present invention may comprise a connection unit 1, a receiving unit 2, a LED assembly 4, a first clip unit 4, and a second clip unit 5.

The connection unit 1 may be connected with an outside of a front-edge groove 210 of the panel 200 of a shelf. In the first embodiment, the connection unit 1 may include a hook portion 11, a vertical plate portion 12, an L-shaped plate portion 13, and a bolt 14. The vertical plate portion 12 may be flush with the outside of the front-edge groove 210. The hook portion 11 may be connected to a top end of the vertical plate portion 12 and against inside the front-edge groove 210. The L-shaped plate portion 13 may have a horizontal section 131 and a vertical section 132. The horizontal section 131 may be connected to a bottom end of the vertical section 12 and extended toward the panel 200 of the shelf so that the horizontal section 131 is disposed under the panel 200 of the shelf. The vertical section 132 may be connected to one end of the horizontal section 132 distant from the vertical plate portion 12 and extended upwardly. And the bolt 14 may be passing through the vertical section 132 of the L-shaped plate portion 13 and against an inside of the front-edge groove 210.

The receiving unit 2 may be connected with one side of the panel 200 of the shelf distant from the connection unit 1 and inclined upwardly and outwardly. That is, the receiving unit 2 may be connected to the bottom end of the vertical plate portion 12 of the connection unit 1 and extended outwardly and upwardly. The receiving unit 2 may be extrusion.

The LED assembly 3 may be arranged at an upper surface of the receiving unit 2. Lights of the LED assembly 3 may be emitted toward inside the panel 200 of the shelf. Besides, the LED assembly 3 may include a plurality of LEDs spaced from each other. The LED assemble 3 is a strip so as to be accommodated in the receiving unit 2.

The first clip unit 4 may be connected with one end of the receiving unit 2 distant from the connection unit 1 for providing a first display strip 300 to be removably clipped and fastened. The first display strip 300 may show trademark or name of products. The first display strip 300 may be made by transparent or semi-transparent materials. Therefore, lights of the LED assembly 3 may also emit to a back of the first display strip 300 so that the LED assembly 3 may be served as a backlight module.

The second clip unit 5 may extend from a bottom end of the receiving unit 2 downwardly for providing a second display strip 310 to be removably clipped and fastened. The second display strip 310 may show price of products. The second display strip 310 may be made by opaque materials.

Figure 3:
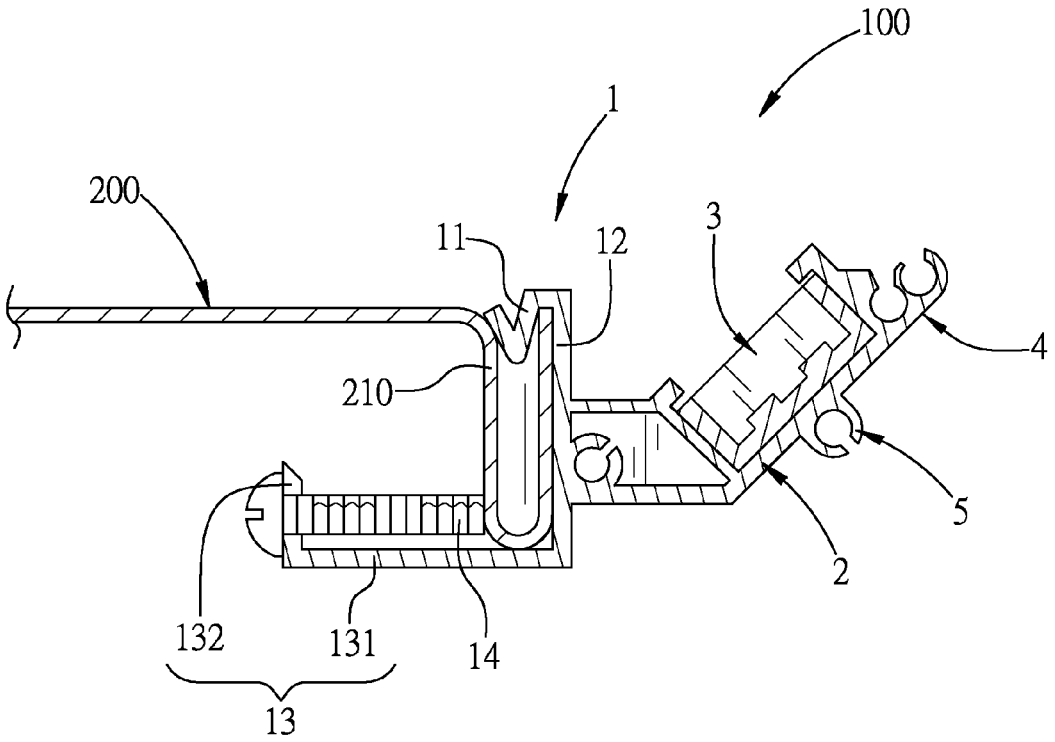
FIG. 3 is a cross-sectional view of the first embodiment according to this present invention.
Figure 4:
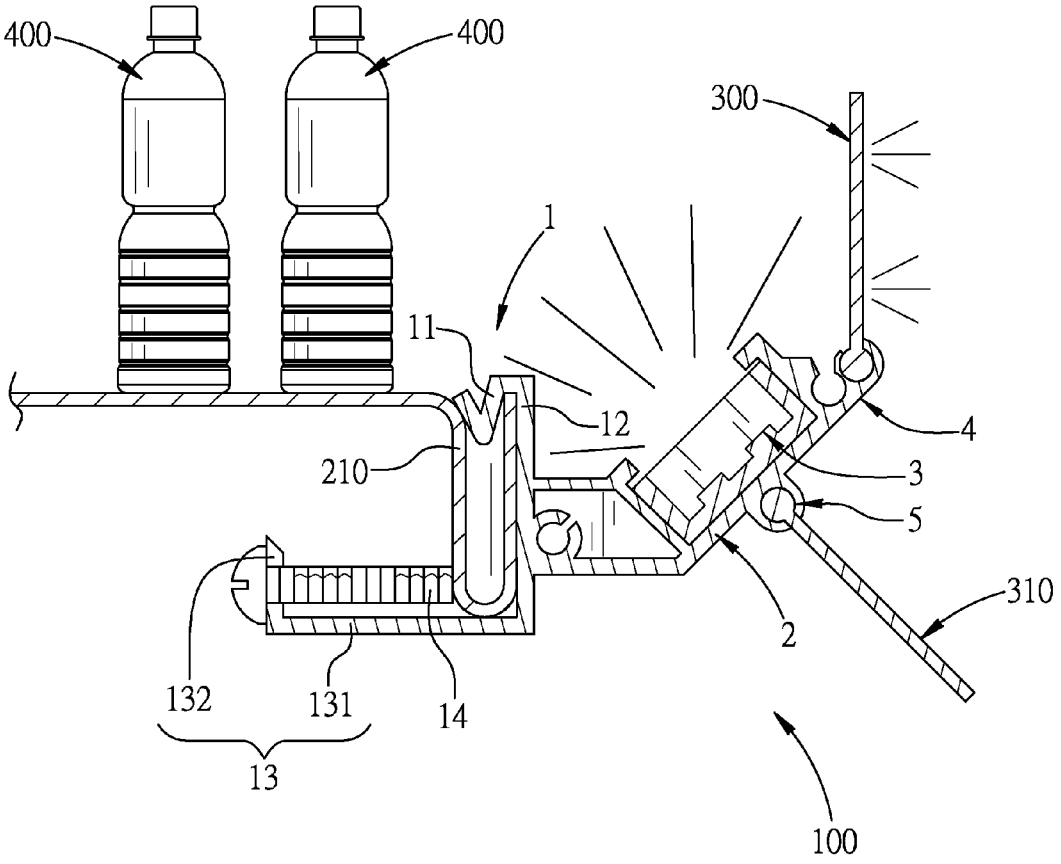
FIG. 4 is a cross-sectional view of the first embodiment according to this present invention while in use.
Figure 5:
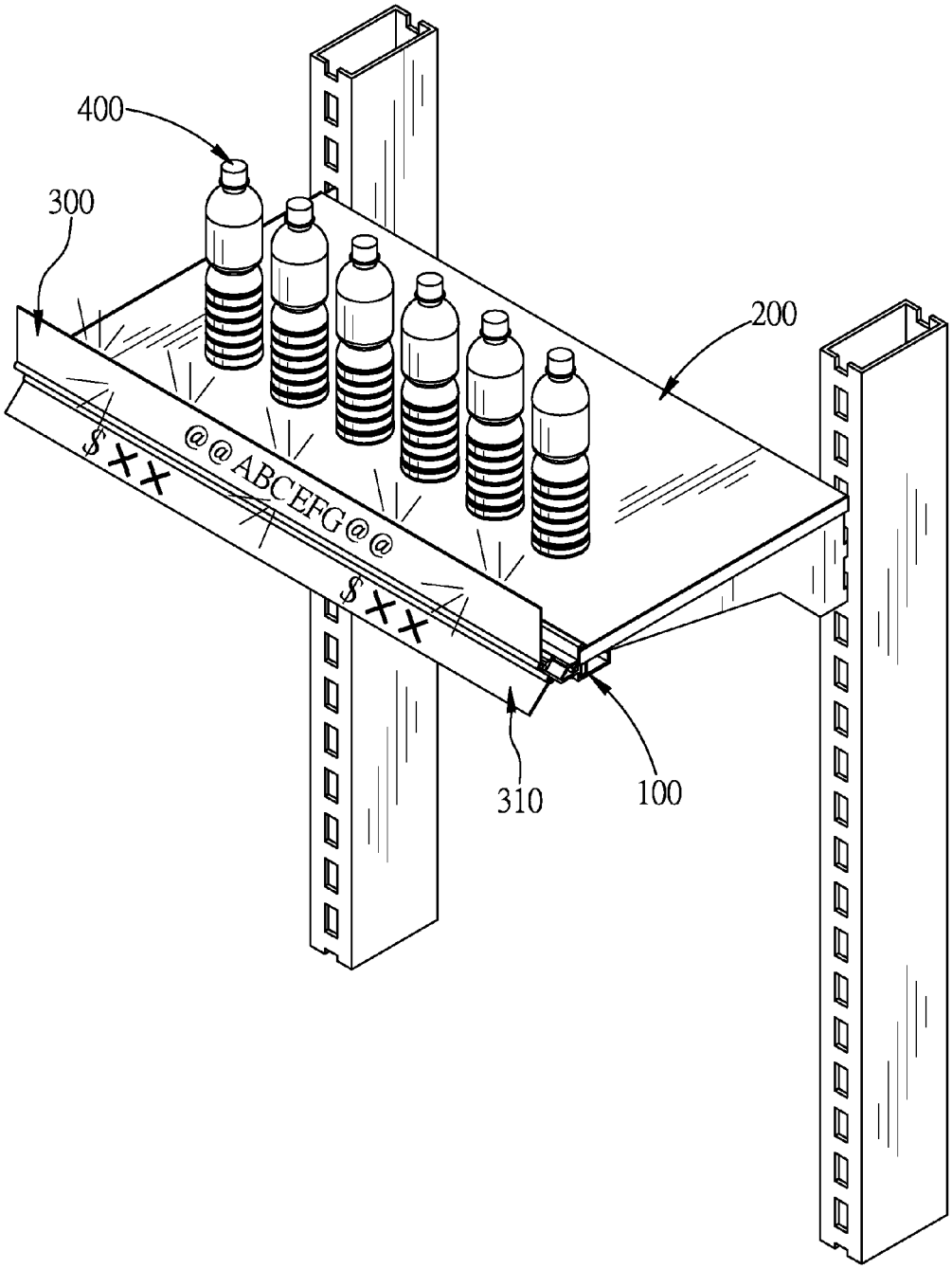
FIG. 5 is a perspective view of the first embodiment according to this present invention while in use.
Figure 6:
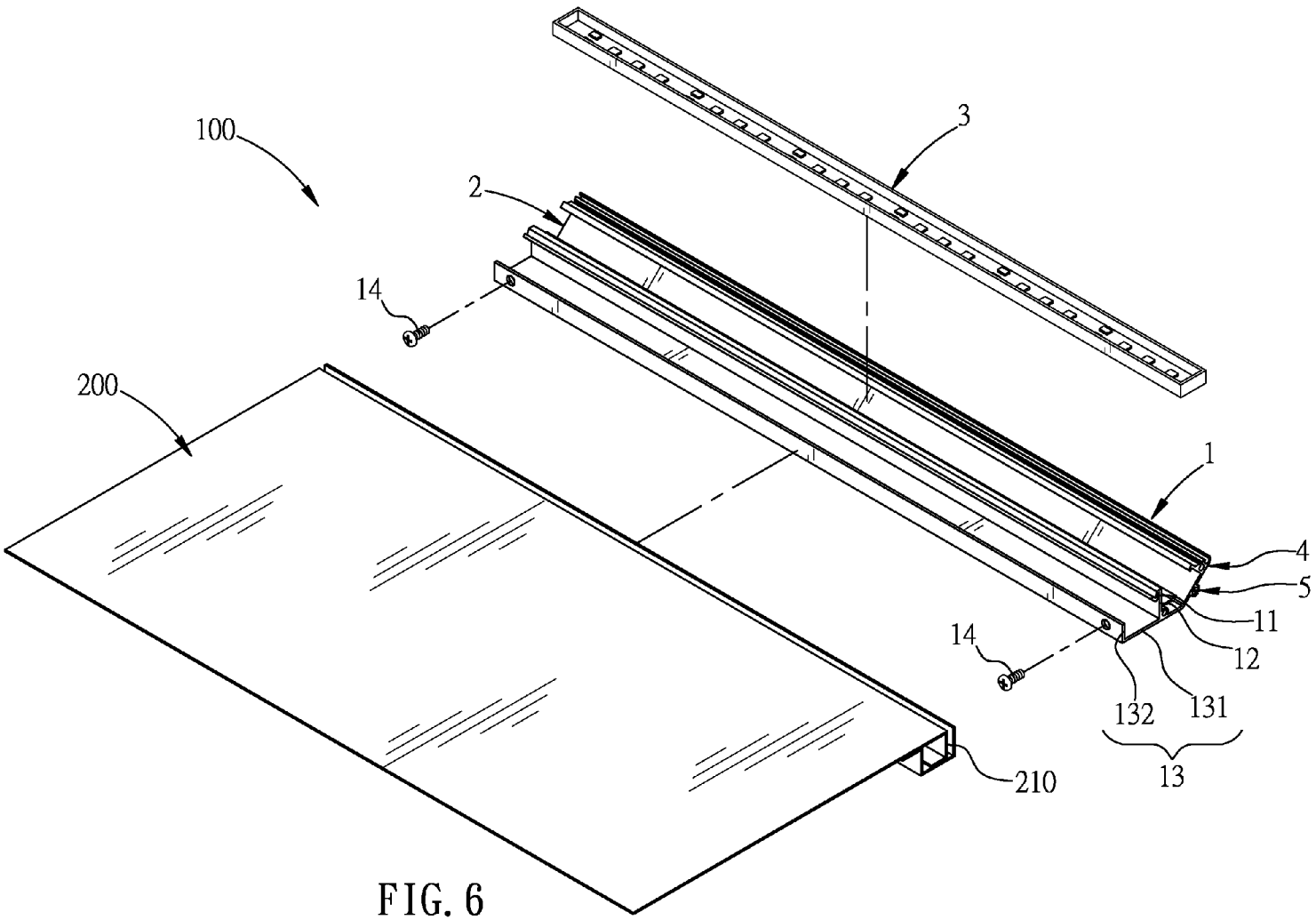
FIG. 6 is an exploded view of the first embodiment according to this present invention while using at a different panel of a shelf.
Figure 7:
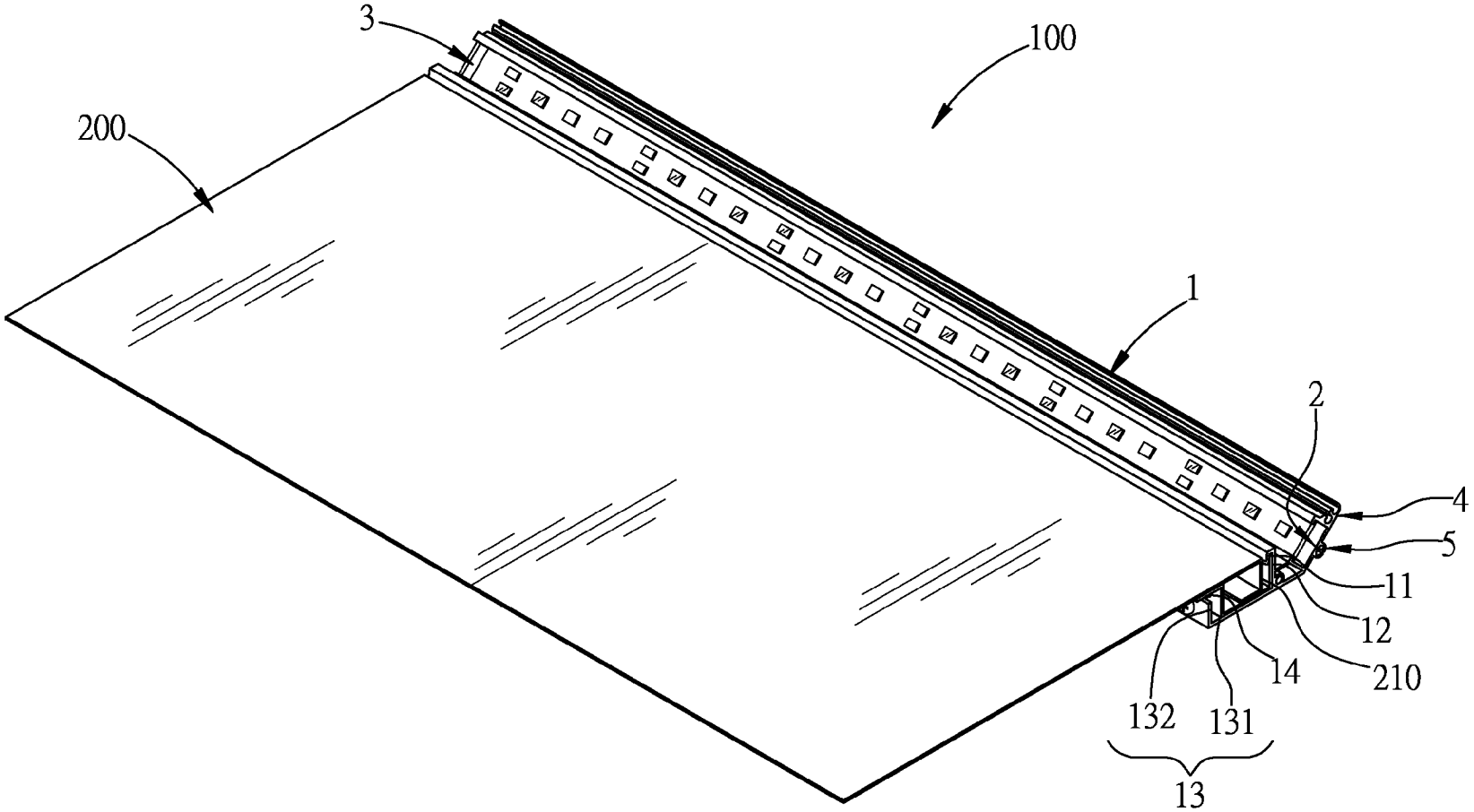
FIG. 7 is a perspective view of FIG. 6.
Figure 8:
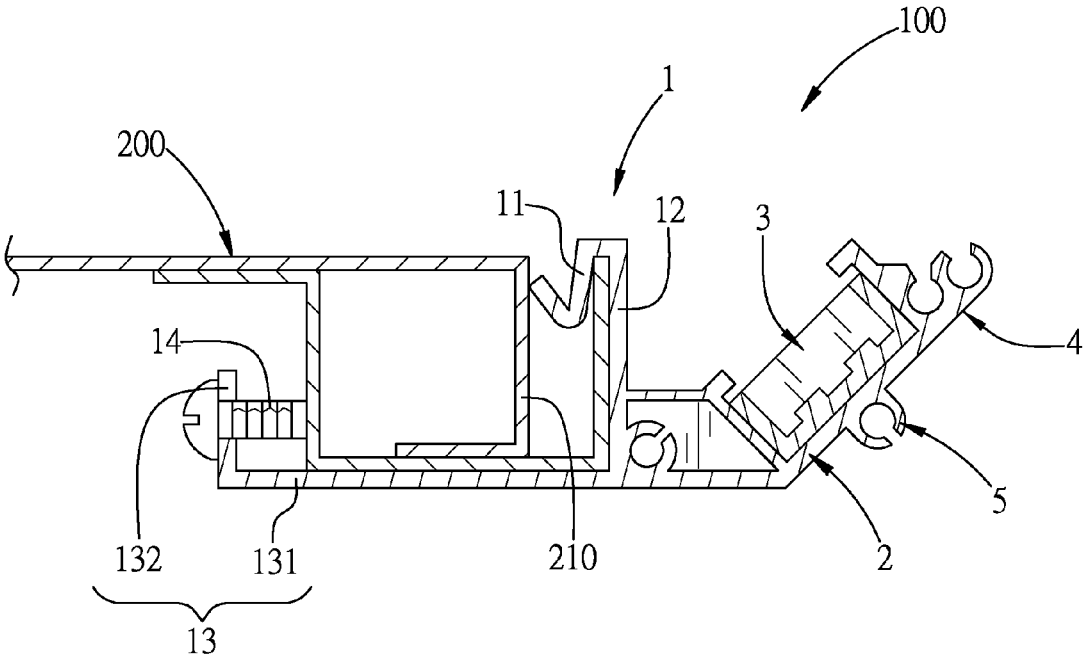
FIG. 8 is a cross-sectional view of FIG. 6.

The length of each bot 14 may be changed according to the difference of the structure of the front-edge groove 210 of the panel 200 (shown as in FIGS. 3 and 8).

Figure 9:
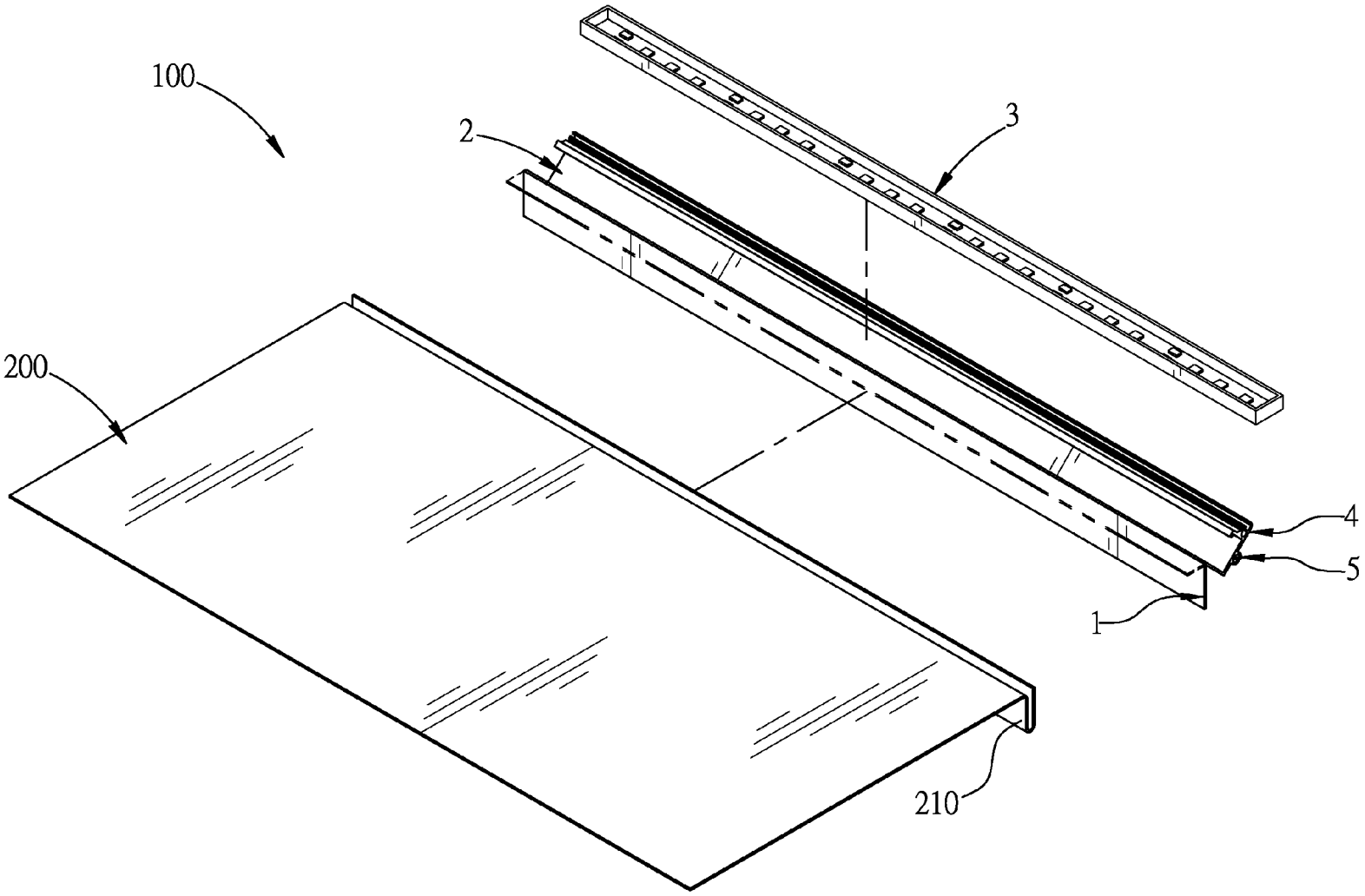
FIG. 9 is an exploded view of a second embodiment of an assembled lighting structure for a panel of a shelf according to this present invention.
Figure 10:
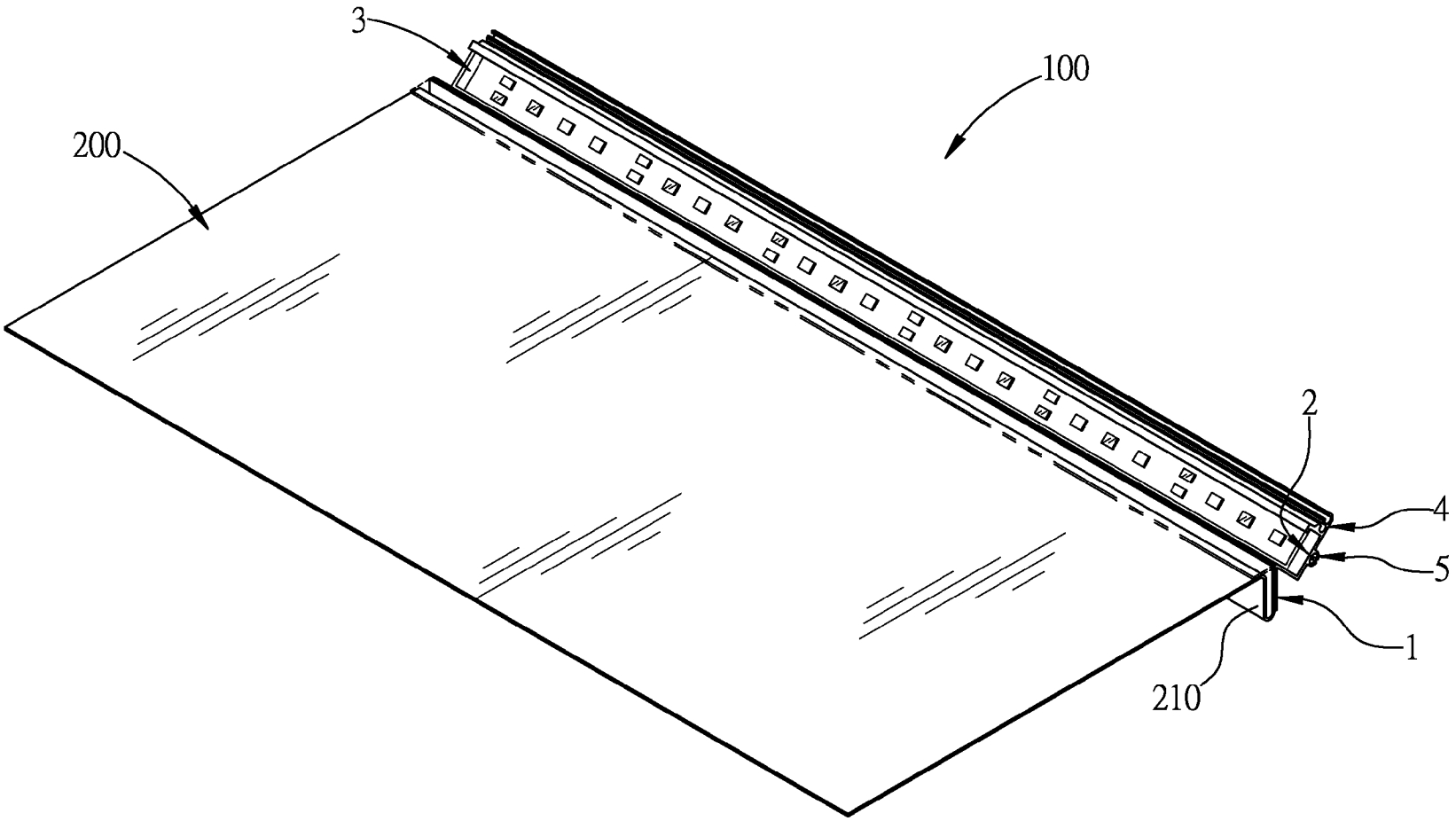
FIG. 10 is a perspective view of the second embodiment according to this present invention.
Figure 11:
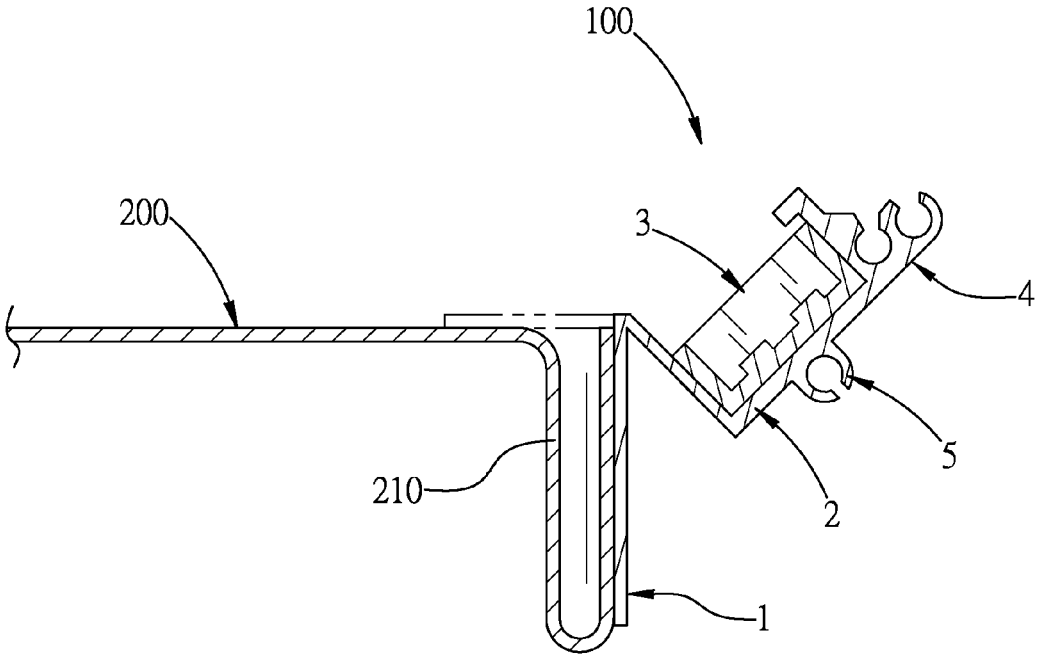
FIG. 11 is a cross-sectional view of the second embodiment according to this present invention.

Please refer to FIGS. 9 to 11, the second embodiment of the assembled lighting structure 100 is similar to the first embodiment. The difference is the connection unit 1.

The connection unit 1 of the second embodiment is a plate which is directly welded at the outside of the front-edge groove 210. The receiving unit 2 is connected to the bottom end of the connection unit 1 and extended outwardly and upwardly.

Figure 12:
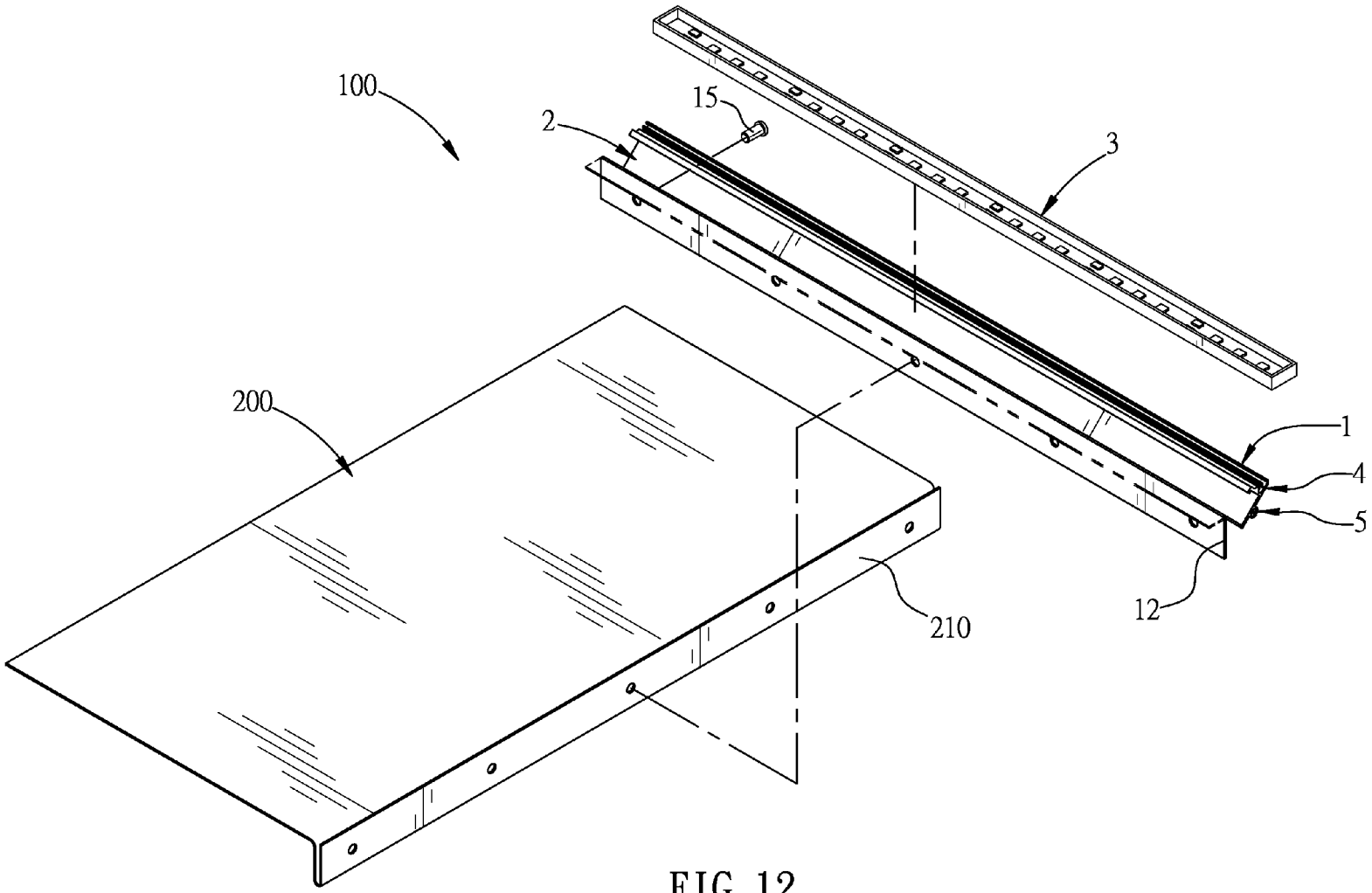
FIG. 12 is an exploded view of a third embodiment of an assembled lighting structure for a panel of a shelf according to this present invention.
Figure 13:
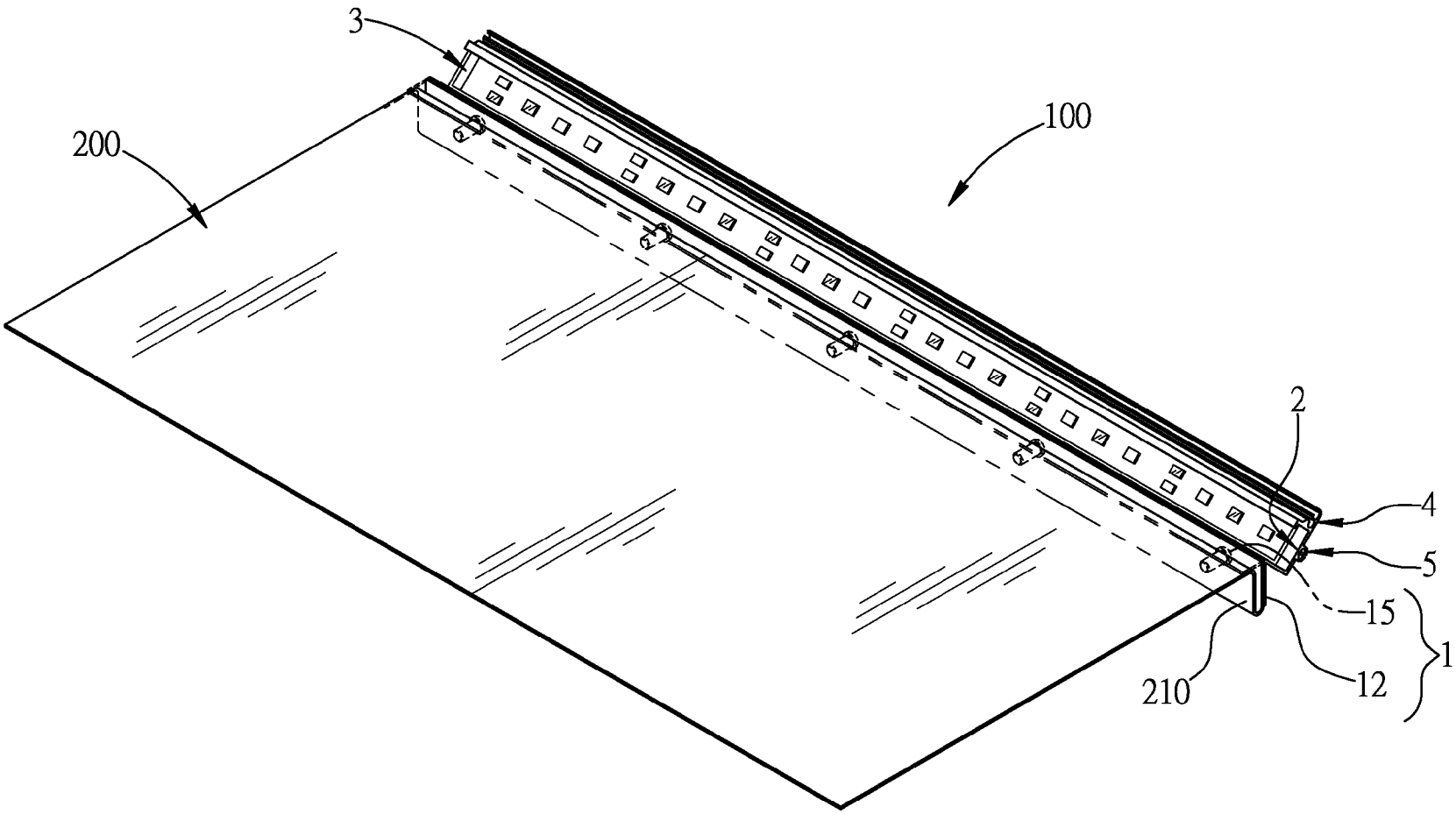
FIG. 13 is a perspective view of the third embodiment according to this present invention.
Figure 14:
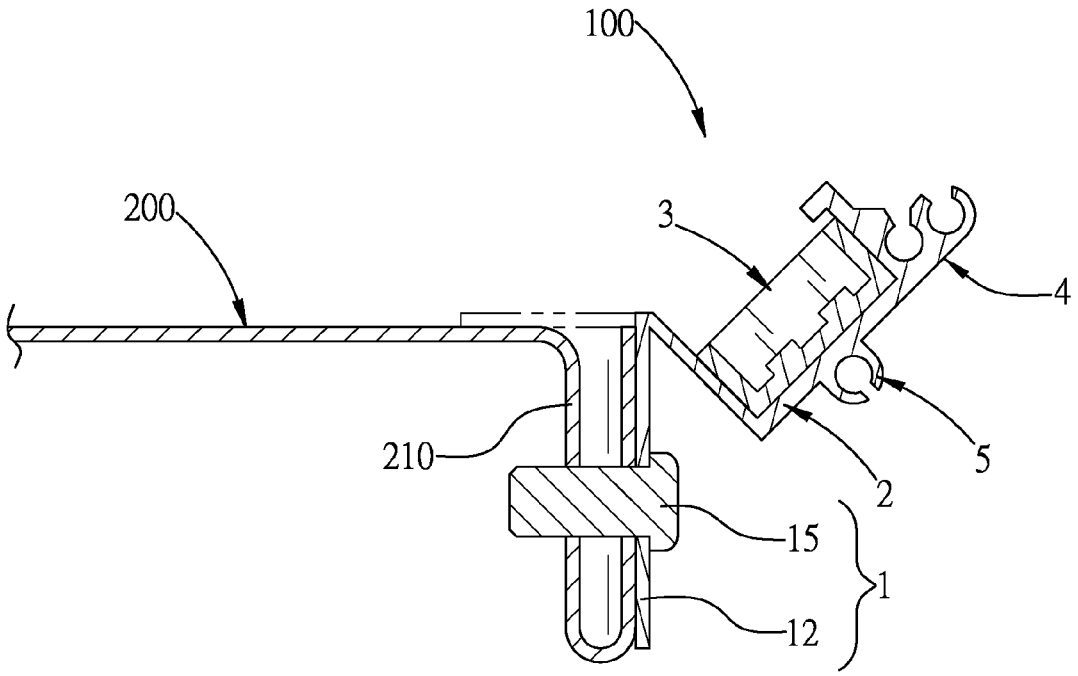
FIG. 14 is a cross-sectional view of the third embodiment according to this present invention.

Please also refer to FIGS. 12 to 14, the third embodiment of the assembled lighting structure 100 is similar to the first embodiment. The difference is the connection unit 1.

The connection unit 1 may include a vertical plate portion 12 and a plurality of bolts 15. The vertical plate portion 12 is flush with the outside of the front-edge groove 210. Each bolt 15 is passing through the vertical plate portion 12 and the outside of the front-edge groove 210 to be fastened at the vertical plate portion 12. And the bolts 15 are spaced apart from each other. The receiving unit 2 is connected to the bottom end of the vertical plate portion 12 of the connection unit 1 and extended upwardly and outwardly.

According above descriptions, the structure 100 is simplified and lights of the LED assembly 3 may be directly emitted to products 400 arranged on the panel 200 (shown as FIGS. 4 and 5) so that the first display strip 300 may be served as a backlight module. Therefore, there is not necessary to use two light sources. And the structure 100 may be also used for clipping and fastening the first display strip 300 shown the trademark and name of the productions 400 and the second display strip 310 shown the price of the productions 400 for saving power and cost down.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. An assembled lighting structure for a panel of a shelf, comprising:

a connection unit, connected with an outside of a front-edge groove of a panel of a shelf;

a receiving unit, connected with one side of the panel of the shelf distant from the connection unit and inclined upwardly and outwardly;

a LED assembly, arranged at an upper surface of the receiving unit, lights thereof are emitted toward inside the panel of the shelf;

a first clip unit, connected with one end of the receiving unit distant from the connection unit for providing a first display strip to be removably clipped and fastened; and a second clip unit, extended from a bottom end of the receiving unit downwardly for providing a second display strip to be removably clipped and fastened.

2. The structure as claimed in claim 1, wherein the connection unit includes a hook portion, a vertical plate portion, an L-shaped plate portion, and a bolt, the vertical plate portion is flush with the outside of the front-edge groove, the hook portion is connected to a top end of the vertical plate portion and against inside the front-edge groove, the L-shaped plate portion has a horizontal section and a vertical section, the horizontal section is connected to a bottom end of the vertical section and extended toward the panel of the shelf so that the horizontal section is disposed under the panel of the shelf, the vertical section is connected to one end of the horizontal section distant from the vertical plate portion and extended upwardly, and the bolt is passing through the vertical section of the L-shaped plate portion and against an inside of the front-edge groove.

3. The structure as claimed in claim 2, wherein the receiving unit is connected to the bottom end of the vertical plate portion of the connection unit and extended outwardly and upwardly.

4. The structure as claimed in claim 1, wherein the connection unit is a plate directly welded at the outside of the front-edge groove.

5. The structure as claimed in claim 4, wherein the receiving unit is connected to the bottom end of the connection unit and extended outwardly and upwardly.

6. The structure as claimed in claim 1, wherein the connection unit includes a vertical plate portion and a plurality of bolts, the vertical plate portion is flush with the outside of the front-edge groove, each bolt is passing through the vertical plate portion and the outside of the front-edge groove to be fastened at the vertical plate portion, and the bolts are spaced apart from each other.

7. The structure as claimed in claim 6, wherein the receiving unit is connected to the bottom end of the vertical plate portion of the connection unit and extended upwardly and outwardly.

8. The structure as claimed in claim 1, wherein the first display strip is made by transparent or semi-transparent materials, and the second display strip is made by opaque materials.

* * * * *